US008353117B2

(12) United States Patent
Paraszczak et al.

(10) Patent No.: US 8,353,117 B2
(45) Date of Patent: Jan. 15, 2013

(54) DECORATIVE BOOT ACCESSORY

(76) Inventors: Jane Paraszczak, Pleasantville, NY (US); Susan Hoddeson, Irvington, NY (US)

( * ) Notice: Subject to any disclaimer, the term of this patent is extended or adjusted under 35 U.S.C. 154(b) by 398 days.

(21) Appl. No.: 12/816,518

(22) Filed: Jun. 16, 2010

(65) Prior Publication Data

US 2011/0308111 A1 Dec. 22, 2011

(51) Int. Cl.
*A43B 23/00* (2006.01)

(52) U.S. Cl. ..... 36/136; 36/100; 2/338

(58) Field of Classification Search ..... 36/100, 36/101, 136; 2/338
See application file for complete search history.

(56) References Cited

U.S. PATENT DOCUMENTS

| | | | | |
|---|---|---|---|---|
| 4,528,700 | A * | 7/1985 | Johnston | 2/338 |
| 5,367,714 | A * | 11/1994 | Hines et al. | 2/311 |
| 5,501,022 | A * | 3/1996 | Cohn | 36/2 R |
| 5,988,467 | A * | 11/1999 | Brustein | 224/222 |
| 2005/0198872 | A1* | 9/2005 | Correa | 36/136 |
| 2010/0132226 | A1* | 6/2010 | Dochter | 36/136 |
| 2010/0307031 | A1* | 12/2010 | Granito | 36/136 |
| 2011/0167540 | A1* | 7/2011 | Little | 2/312 |
| 2012/0042545 | A1* | 2/2012 | Dickerson | 36/136 |
| 2012/0047773 | A1* | 3/2012 | Schrader | 36/136 |
| 2012/0047774 | A1* | 3/2012 | Schrader | 36/136 |
| 2012/0060263 | A1* | 3/2012 | Harber et al. | 2/338 |
| 2012/0174442 | A1* | 7/2012 | Castle | 36/136 |
| 2012/0192460 | A1* | 8/2012 | Barnhart | 36/136 |

* cited by examiner

*Primary Examiner* — Marie Patterson
(74) *Attorney, Agent, or Firm* — Leason Ellis LLP

(57) ABSTRACT

A boot accessory for attachment and wear along an upper portion of a boot for altering and enhancing the overall appearance of the boot includes a clip having a main body, a flexible finger extending from the main body, and first and second side body extensions that define first and second slots along two opposing sides of the main body. A space is formed between the finger and an inner surface of the main body for receiving an upper edge of the boot. The boot accessory also includes a decorative boot band having a first end and an opposing second end. The first end is fixedly attached to the first side body extension by passing through the first slot. An inner surface of the boot band includes at least one fastening element to permit the second end of the boot band to be folded onto itself and be attached to the inner surface of the boot band by first passing through the second slot and then being folded and attached to the inner surface so as to form a continuous circumferential member.

14 Claims, 8 Drawing Sheets

DECORATIVE BOOT ACCESSORY

TECHNICAL FIELD

The present invention relates a boot accessory, and in particular, to a clip and decorative boot band assembly that can be easily attached to an upper portion of a boot, thereby enhancing and interchangeably altering the overall appearance of the boot.

BACKGROUND

A boot is a type of footwear. It mainly covers the foot and the ankle and extends up the leg, sometimes as far as the knee or even the hip. Many boots have a heel that is clearly distinguishable from the rest of the sole, even if the two are made of one piece. Traditionally made of leather or rubber, modern boots are made from a variety of materials. Boots are worn both for their functionality (e.g., protecting the foot and leg from water, snow, mud or hazards or providing additional ankle) and for fashion. Accordingly, boots come in a number of different sizes and styles. Boots that are worn as a fashion statement are often worn with clothing that complements the boots in order to display the boots. The top portion of the boot is thus worn around the leg above the ankle and typically below the knee.

One of the disadvantages of women's footwear, including boots, is that fashion trends change from year to year and therefore, boots from one season can be out of date the next season.

SUMMARY

In one embodiment, a boot accessory for attachment and wear along an upper portion of a boot for altering and enhancing the overall appearance of the boot includes a clip having a main body, a flexible finger extending from the main body, and first and second side body extensions that define first and second slots along two opposing sides of the main body. A space is formed between the finger and an inner surface of the main body for receiving an upper edge of the boot. The boot accessory also includes a decorative boot band having a first end and an opposing second end. The first end is fixedly attached to the first side body extension by passing through the first slot. An inner surface of the boot band includes at least one fastening element to permit the second end of the boot band to be folded onto itself and be attached to the inner surface of the boot band by first passing through the second slot and then being folded and attached to the inner surface so as to form a continuous circumferential member.

A method for accessorizing a boot and changing its overall appearance includes the steps of: (1) providing a boot accessory that includes a clip having a main body, a flexible finger extending from the main body, and first and second side body extensions that define first and second slots along two opposing sides of the main body, the boot accessory further including a decorative boot band having a first end and an opposing second end, the first end being fixedly attached to the first side body extension by passing through the first slot; (2) attaching the boot accessory to an upper edge of the boot by inserting the upper edge of the boot into a space defined between the finger and the main body and moving the clip down along the boot until the upper edge seats against the top of the clip; (3) wrapping the boot band around an upper leg portion of the boot; (4) inserting the second end of the boot band through into and through the second slot and folding the second end of the boot band onto itself; and (5) attaching the folded second end of the boot band to an inner surface of the boot band using a fastening means such that the boot band extends circumferentially around the upper leg portion of the boot and is held in place therealong; whereby the side body extensions are shaped and located along the sides of the main body such that the topmost portion of the clip is above the first and second slots thereby resulting in a topmost section of the upper leg portion of the boot being visible above an upper edge of the boot band.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
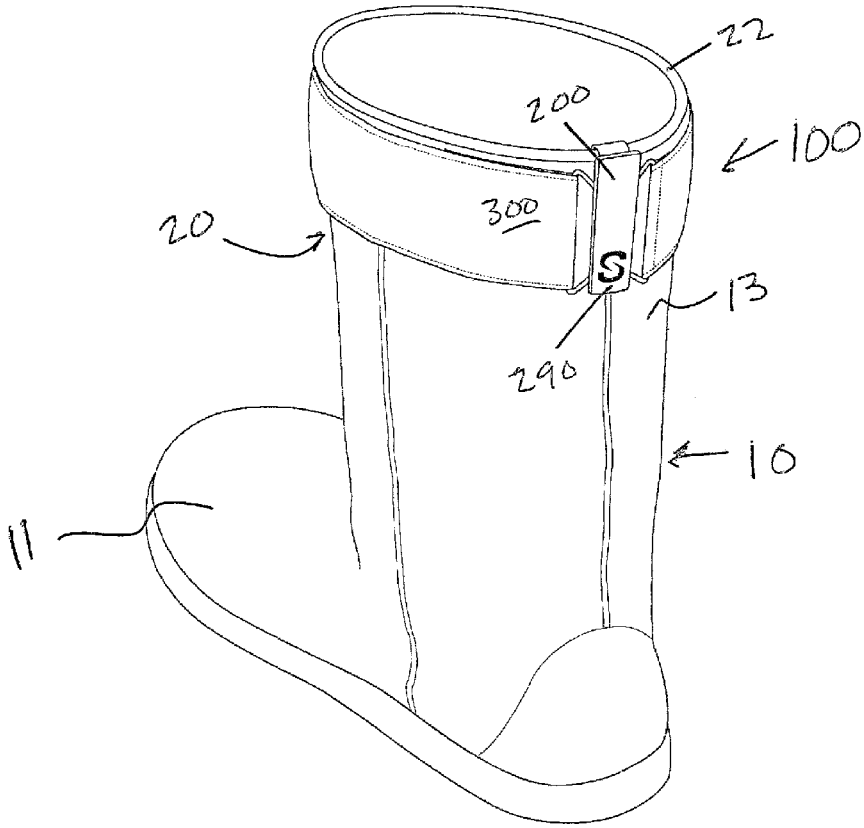
FIG. 1 is a rear and side perspective view of a boot with a boot accessory according to a first exemplary embodiment of the present invention.

In accordance with a first embodiment of the present invention, a boot accessory 100 is shown in FIGS. 1-5 for being removably worn on a boot 10. The boot accessory 100 is designed to be worn around a top portion 20 of a boot 10. The top portion 20 terminates with a top edge 22. Boots 10 can be made from any number of different materials, including leather, suede, fabric, synthetic materials, etc. The boot 10 can be generally thought of as having a foot portion 11 and a leg portion 13 that extends upwardly from the foot portion 11.

The boot accessory 100 is shown attached to the top portion 20 of the boot 10 in such a manner, as described below, that the top edge 22 of the boot 10 is visible above the boot accessory 100 about the circumference of the leg portion 13 of the boot 10.

Figure 3:
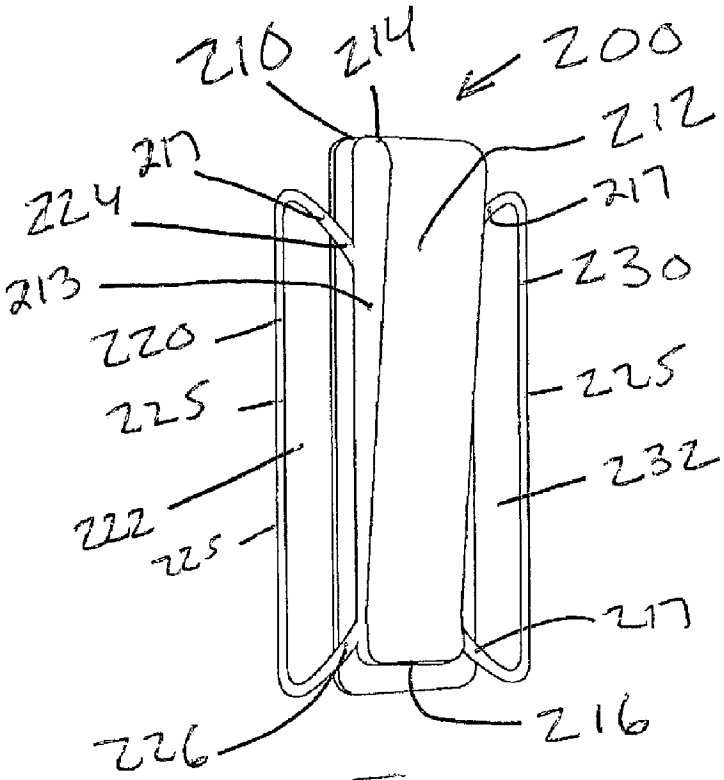
FIG. 3 is a rear elevation view of the boot accessory of FIG. 1.
Figure 2:
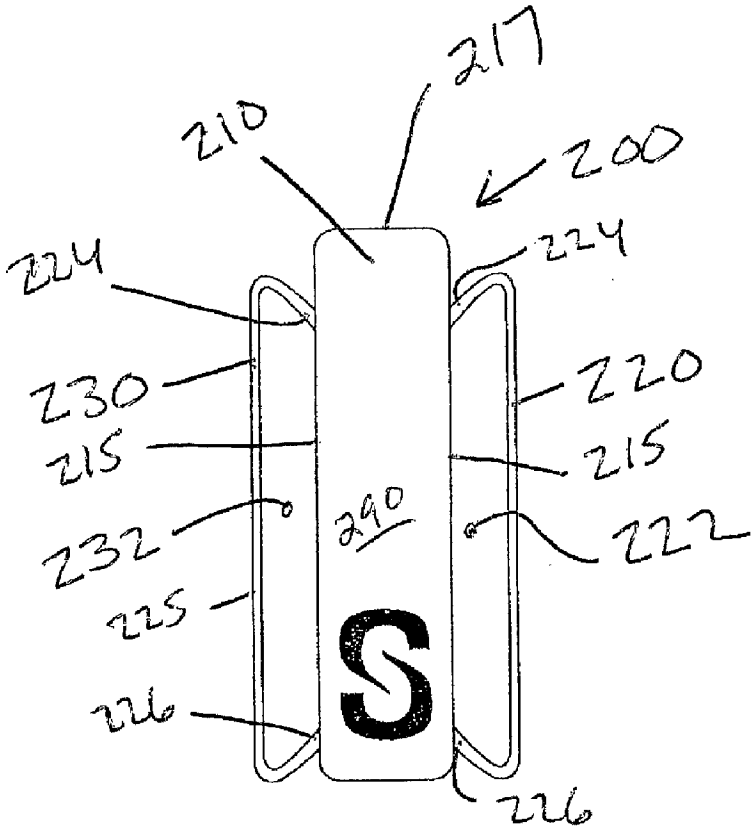
FIG. 2 is a front elevation view of the boot accessory of FIG. 1.
Figure 4:
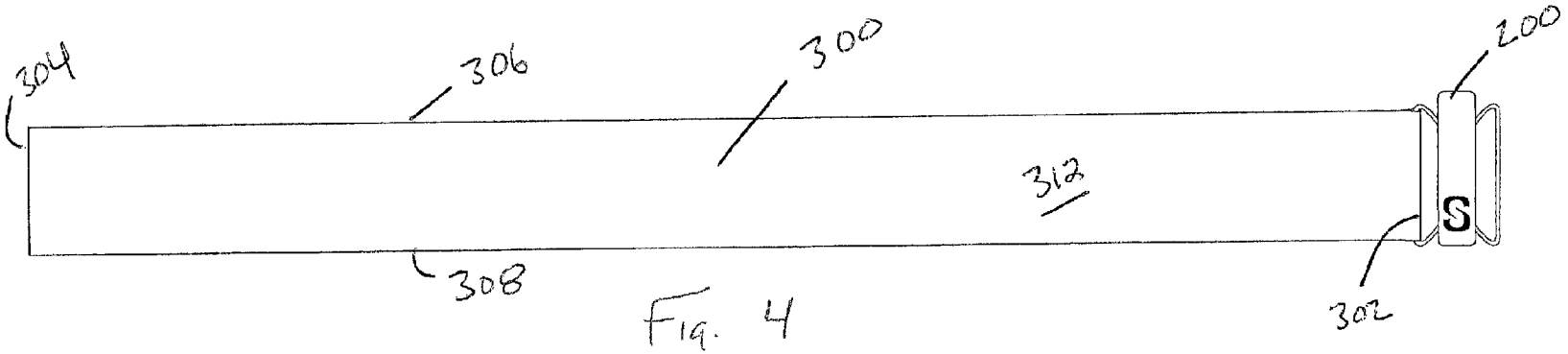
FIG. 4 is a front elevation view of a clip that is part of the boot accessory of FIG. 1.

As shown in FIGS. 2-3, the boot accessory 100 is in the form of an elongated boot band that is formed of and defined by a boot clip 200 and a boot band 300 that is coupled to the clip 200 and extends about the leg portion 13 of the boot 10. The boot clip 200 has a central section (main body) 210 and a pair of side body extensions 220, 230 that extend radially outward from the main body 210. Between the side body extension 220 and the main body 210, a first slot 222 is formed and similarly, between the second body extension 230 and the main body 210, a second slot 232 is formed.

Figure 5:
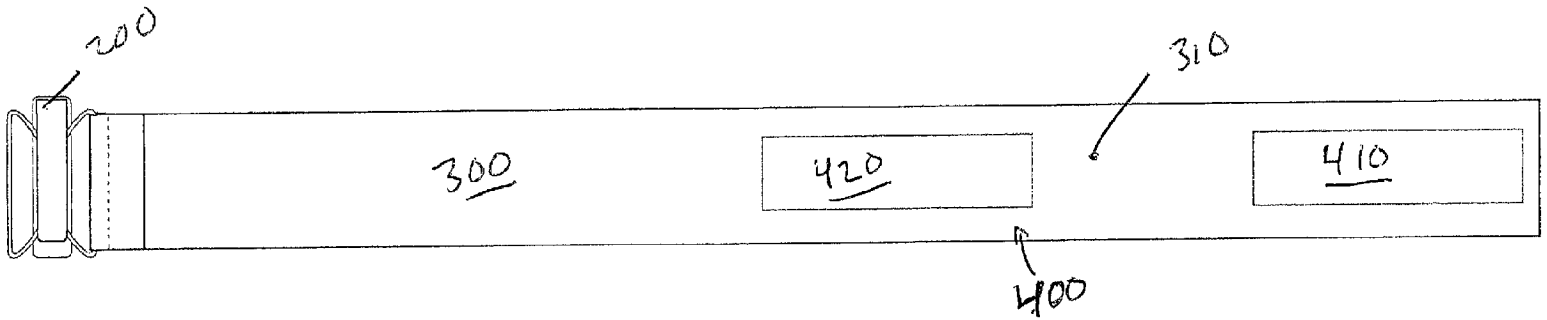
FIG. 5 is a rear elevation view of the clip that is part of the boot accessory of FIG. 1.

As best shown in FIG. 5, the main body 210 is in the form of a clip in that it includes a flexible finger 212 that extends outwardly therefrom and can have some degree of movement (flexing) relative to the main body 210. More specifically, the finger 212 is attached at one end 214 to the main body 210 while the opposite end 216 is a free end. It will be appreciated that the finger 212 and main body 210 and the other parts of the clip can be formed as a single integral piece or can be formed of different parts that are assembled, bonded, or otherwise mechanically fixed to one another.

The pair of side body extensions 220, 230 is in the form of wing-like structures each of which extends outwardly from the main body 210. The side extension 220, 230 has a first end 224 that is attached to the main body 210 near the end 214 of the finger 212, while a second end 226 of the side extension 220 is attached to the main body 210 near the free end 216 of the finger 212. The side extension 220, 230 has a planar middle section 225 that is at least substantially parallel to a side edge 215 of the main body 210 and includes two angled sections 217 at its ends that attach to the main body 210. As shown in the figures, the side body extension 220, 230 can be in the form of a thin rail or rod like member (metal or plastic) that is attached as its ends to the main body 210. The clip 200 thus has a symmetrical look due to the symmetry of the side extensions 220, 230 and in the illustrated embodiment, the clip 200 has a butterfly-like shape; however, the shape of the side extension 220,230 is not limited to the illustrated shape and instead can have any number of other shapes, including more rectangular, semi-circular, crescent, etc.

In one embodiment, as shown, clip 200 can be formed of a planar front plate and a clip structure that is in the form of the clip (finger 212) and the side body extensions 220, 230. In other words, the flexible clip portion 212 and the side body extensions 220, 230 can be a single part that is fastened to the front plate to form the clip. However, the clip 200 can be formed as a single unitary part.

The decorative boot band 300 is an elongate structure that has a first end 302, an opposing second end 304, a top edge 306 and an opposing bottom edge 308. The decorative boot band 300 also has an inner surface 310 and an opposing outer surface 312 that faces outward and is visible to the wearer and others. The decorative boot band 300 can be formed of any number of different materials, including fabrics, leather, etc. It will be appreciated that a wide degree of different indicia can be added to the outer surface 312 to provide a decorative look. For example, the decorative boot band 300 can have a print and/or it can have sequences, tassels, or other material or objects that provide a decorative appearance and can be supported by the base material of the boot band 300. For ease and simplicity, the illustrated boot band 300 is shown without indicia.

The first end 302 is fixedly attached to the clip 200 by being inserted into the first slot 222 and then being either securely attached to itself or to the clip 200. Any number of different techniques can be used to attach the first end 302 to the clip 200. For example, fasteners, such as rivets, or stitching or other techniques can be used to effectively attach the first end 302 to the clip 200 such that the boot band 300 extends within the slot 222.

On the inner surface 310 of the boot band 300, a fastening element 400 is provided for securely attaching the boot accessory 100 to the boot 10. The fastening element 400 includes a first fastening element 410 and a second complementary fastening element 420. In one embodiment, as illustrated, the first and second fastening elements 410, 420 are formed of hook and loop material that when mated to one another resulting in the boot band 300 being attached to itself. However, it will be appreciated that other fastening techniques can be used to attach the second end 304 of the boot band 300 in a manner such that the overall length of the boot band 300 that extends about the boot 10 is variable to allow the boot accessory 100 to be used with a number of different sizes and styles of boots.

Figure 6:
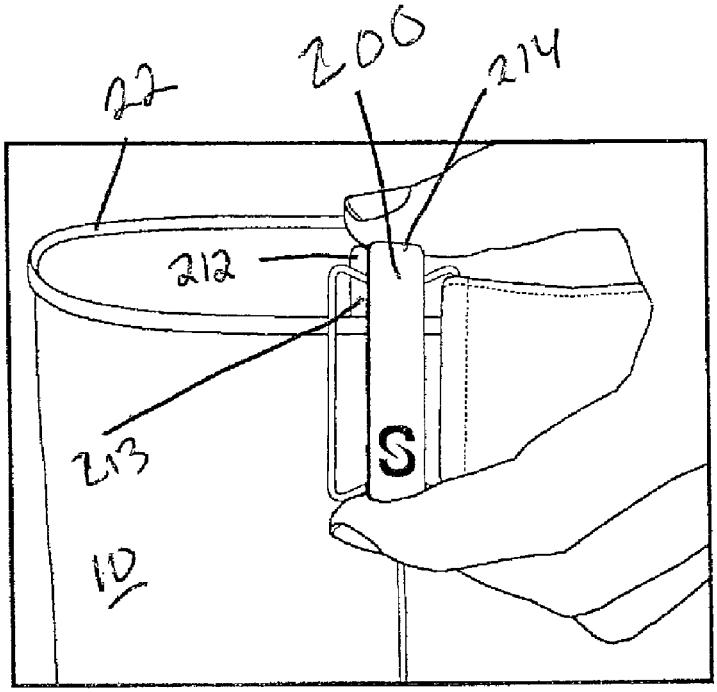
FIG. 6 is a partial perspective view of a top portion of the boot showing a first step in securing the boot accessory to the boot by fastening a first end of the boot accessory to the boot.
Figure 7:
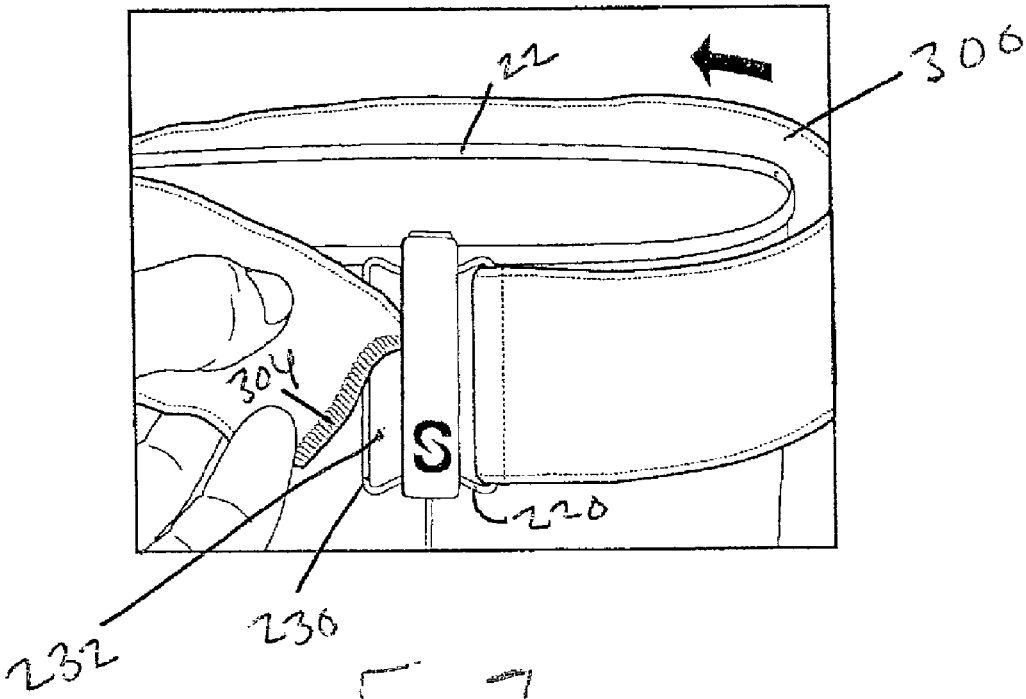
FIG. 7 is a partial perspective view of the top portion of the boot showing a second step in which a second end of the boot accessory is inserted into the clip.

FIG. 6 shows a first step in attaching the accessory 100 to the boot. The boot accessory 100 is first coupled to the boot 10 by first placing the clip 200 on over the top edge 22 of the boot 10. In particular, the top edge 22 of the boot 10 is inserted into a space 213 that is formed between the main body 210 and the flexible finger 212. The clip 200 is moved downwardly as shown in FIG. 7 until the top edge 22 of the boot 10 contacts or is proximate a wall created where the end 214 of the finger 212 interfaces with the central section of the main body 210. The clip 200 thus rests on the top edge 22 of the boot 10.

Figure 8:
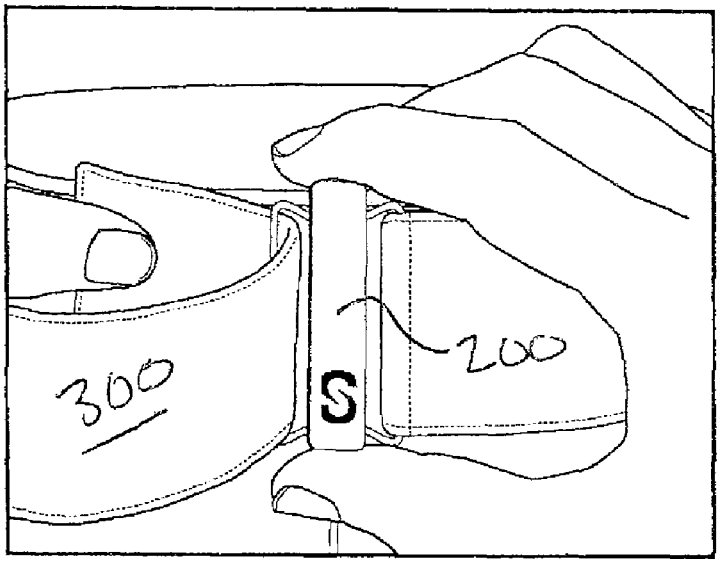
FIG. 8 is a partial perspective view of the top portion of the boot showing a third step in which the second end of the boot accessory is folded back over itself.
Figure 9:
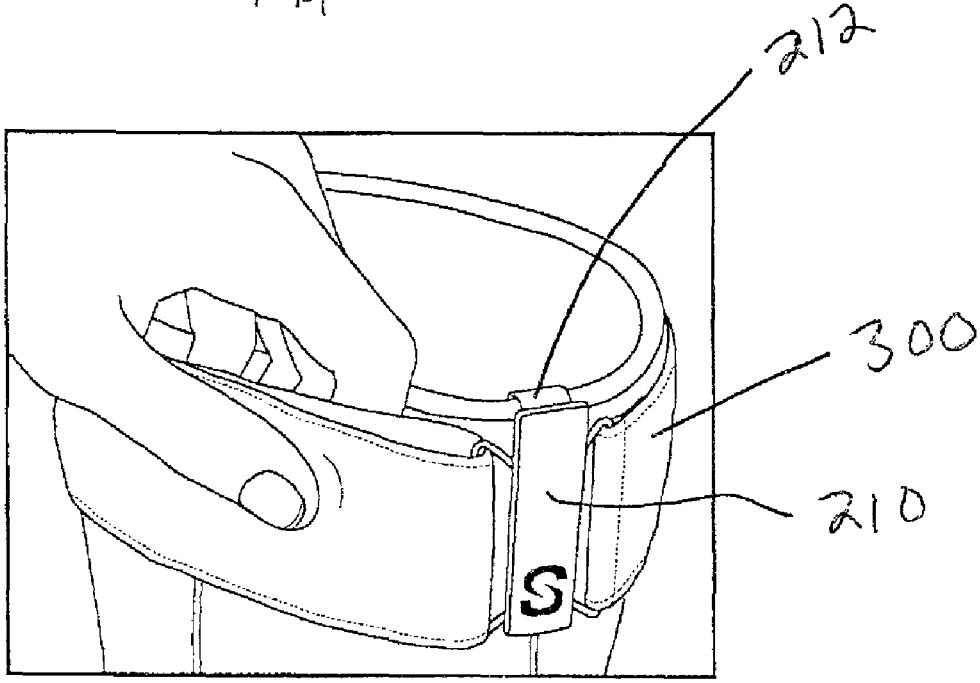
FIG. 9 is a partial perspective view of the top portion of the boot showing a fourth step in which the folded section of the second end of the boot accessory is fastened to itself.

As shown in FIG. 7, when the boot accessory 100 is first coupled to the boot 10 and in place, the side extensions 220, 230 are below the top edge 22 and are adjacent the leg portion of the boot 10. The second end 304 of the boot band 300 is then wrapped around the top portion of the boot 10 and is inserted into the second slot 232 of the clip 200. The second end 304 is inserted into the slot 232 in a direction toward the boot 10 and the second end 304 of the boot band 300 is then folded over toward the inner surface 310 of the boot band 300. The second end 304 is pulled through the slot 232 (FIG. 8) until the boot band 300 is snug around the top portion of the boot 10. Once the boot band 300 is snug, the second end 304 of the boot band is securely, yet detachably, coupled to the inner surface 310 of the boot band 300 using the fastening element 400 (FIG. 9). For example, when the fastening element 400 is of a hook and loop type, the first and second fastening elements 410, 420 are brought into contact and engagement with one another resulting in the second end 304 of the boot band 300 being securely attached to itself.

Since the slots 222, 232 receive the decorative boot band 300, it is the location of the slots 222, 232 which is dictated by the shapes and locations of the side extensions 220, 230 that control and limit the degree of travel of the band 300 within the slots 222, 232. In particular, in order to allow the top edge 22 of the boot 10 to be visible above the boot accessory 100 about the circumference of the leg portion 13 of the boot 10, the topmost end of the slot 222 is lower than a top edge 217 of the main body 210 when the clip 200 is vertical. In other words, the top edge 217 and the end 214 of the finger 212 are above the end of the topmost end of the slot 222 and therefore, when the decorative band 300 is inserted into the slot 222, the decorative band is automatically and advantageously spaced, a predefined distance, from the top edge 22 of the boot 10. When the boot accessory 100 is attached to the top edge 22 of the boot 10, the top edge 217 of the clip 200 is adjacent the top edge 22 of the boot 10. Due to the construction of the side extensions 220, 230 and in particular, the locations of the slots 222, 232, the top edge of the boot band 300 is spaced from the top edge 22 of the boot 10 to give the desired look of a small band of boot above the accessory 100. Thus, the top edge of the boot band 300 is naturally spaced or offset from the top edge 22 of the boot 10 unlike other products.

As mentioned above, this allows a small annular shaped band of boot material to be visible above the boot accessory 100 when the boot accessory 100 is worn on the boot 10 (FIG. 1). This provides a fresh, clean classic look due to the presence of the boot material both above and below the band with only a small band being visible above. Conventional boot accessories fail to provide such a clean, pleasing look and fail to control and always provide an annular band of boot, of a prescribed size, above the boot accessory 100.

To remove the boot accessory 100, the above steps are simply reversed.

Figure 10:
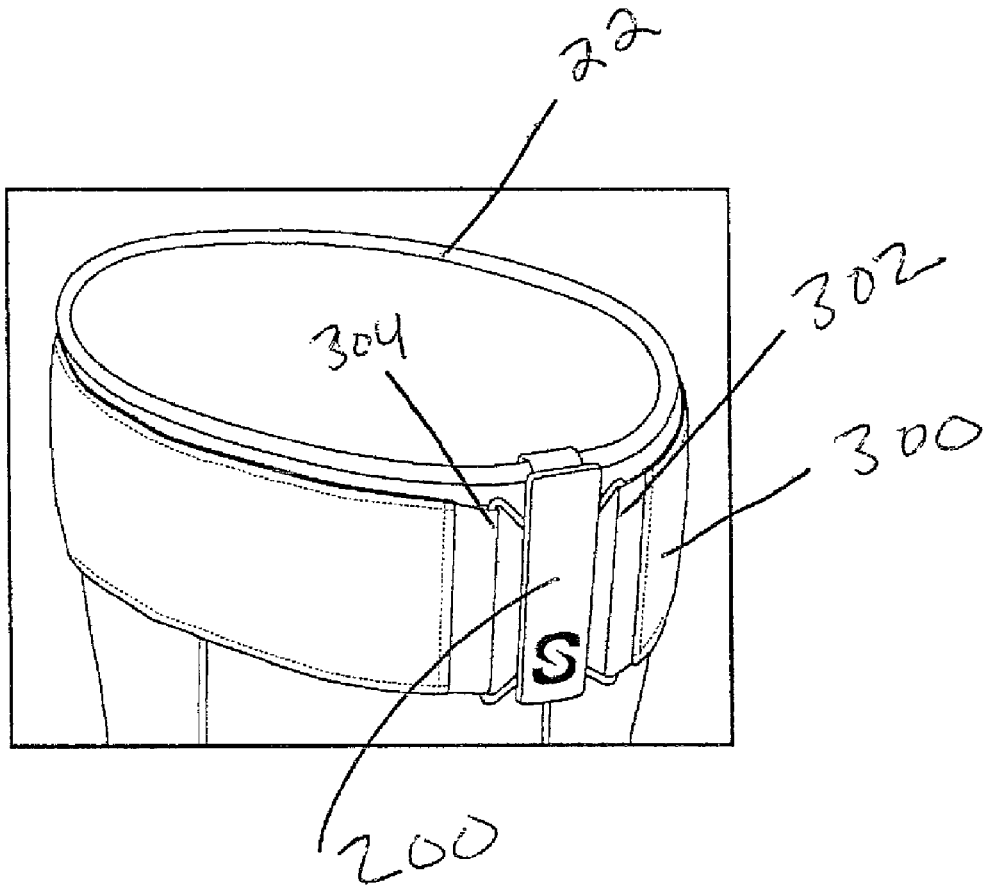
FIG. 10 is a partial perspective view of a top portion of the boot including a boot accessory according to a second exemplary embodiment.

FIG. 10 shows another embodiment in which the boot band 300 is fixedly attached at both ends 302, 304 to the clip 200 and in particular, to the side extensions 220, 230. The boot band 300 can be a flexible, expandable/contractable material that allows the boot band 300 to fit different sized boots 10. For example, the boot band 300 can be formed of an elastic material (fabric, etc.).

Figure 11:
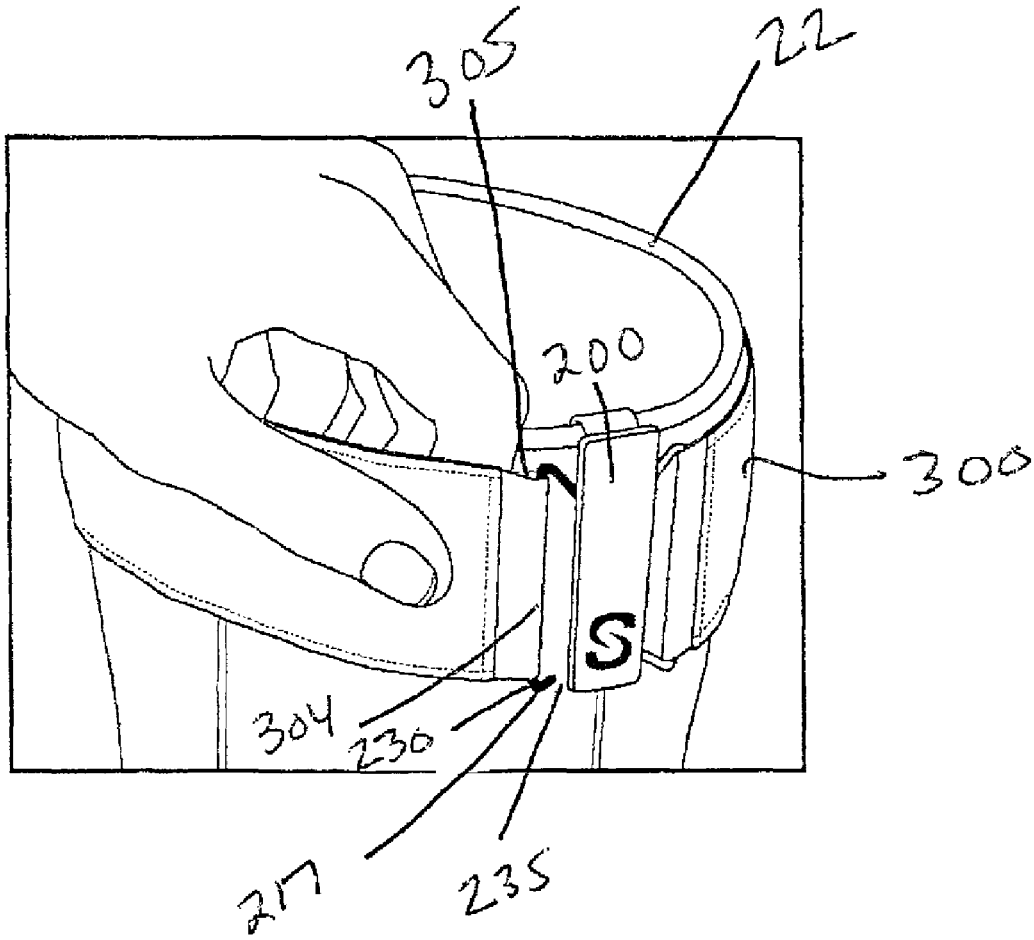
FIG. 11 is a partial perspective view of a top portion of the boot including a boot accessory according to a third exemplary embodiment.

FIG. 11 shows another embodiment in which the boot band 300 is fixedly attached at the first end 302 to the clip 200; however, the second end 304 is releasably attached to the clip 200 by a hook action. More specifically, the second extension 230 is not attached to the main body 210 at the second (lower) end but rather a slit 235 is formed that allows passage of the boot band 300. The second extension 230 thus resembles a hook. The second end 304 of the boot band 300 is looped to include a channel 305 that is sized to receive the side extension 230. To attach the second end 304 of the boot band 300 to the clip 200, the free second end 226 of the second extension 230 is inserted into the channel 305 and the boot band 300 is moved up along the second extension 230 until the top edge is properly positioned in the slot 232. The bottom edge of the band 300 is captured by the lower angled section 217 of the second extension 230 and thus does not easily ride into the slit 235. In this embodiment, the boot band 300 can be either formed of an elastic or non-elastic material and the side extensions 220, 230 control the location of the band 300 and provide the desirable small band of boot to be visible above the accessory 100. It will also be appreciated that the embodiment of FIG. 11 can be modified to provide for different sizing. More specifically, the band 300 can contain a plurality of vertically sewn sections along the length of the band 300 with each section being open ended (forming a slit between two adjacent stitch lines) so as permit the second side extension 230 to be received within one slit (sewn section). Depending upon the boot size, the user can select the most appropriate slit for inserting the hook member.

Figure 12:
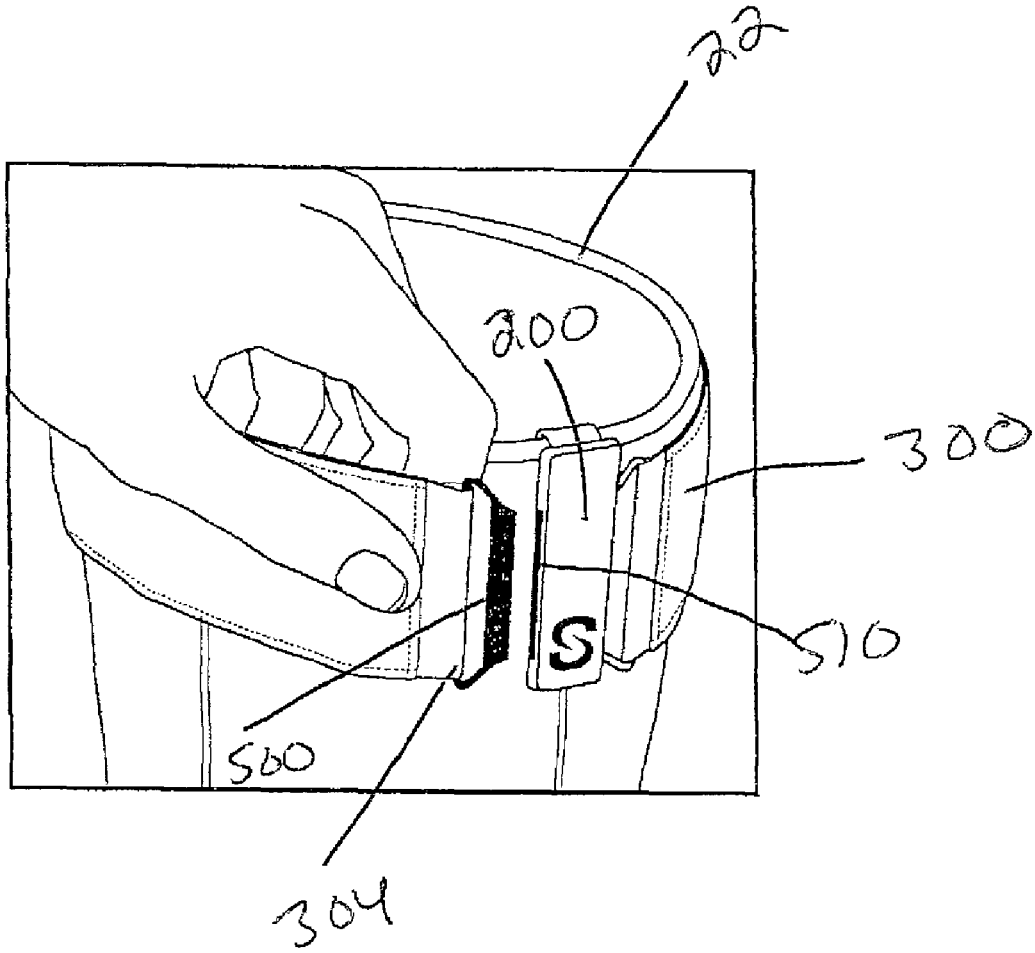
FIG. 12 is a partial perspective view of a top portion of the boot including a boot accessory according to a fourth exemplary embodiment.

FIG. 12 shows another embodiment in which the second end of the boot band 300 engages and locks to the clip 200 using a releasable mechanical attachment. For example, the second end 304 of the boot band 300 can include a first fastener 500 and the clip 200 includes a complementary second fastener 510. When the first and second fasteners 500, 510 mate with one another, a secure fit is made between the second end 304 of the boot band 300 and the clip 200. For example, the first and second fasteners 500, 510 can be male/female interlocking members or the like that provide a releasable interlocking mechanism.

In this embodiment, the boot band 300 can be either formed of an elastic or non-elastic material and the side extensions 220, 230 control the location of the band 300 and provide the desirable small band of boot to be visible above the accessory 100.

The present invention thus provides a boot accessory that can enhance the appearance of the boot. By having boot bands 300 with different designs, a single pair of boots can be given a variety of appearances when the owner would normally have to buy several boots to achieve the same result.

It will also be appreciated that an outer surface 290 of the clip 200 defines a surface on which indicia, such as a corporate name, logo, or other decorative work, can be provided.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A boot accessory for attachment and wear along an upper portion of a boot for altering and enhancing the overall appearance of the boot comprising:

a clip having a main body, a flexible finger extending from the main body, and first and second side body extensions that define first and second slots along two opposing sides of the main body, wherein a space is formed between the finger and an inner surface of the main body for receiving an upper edge of the boot; and a decorative boot band having a first end and an opposing second end, the first end being fixedly attached to the first side body extension by passing through the first slot, wherein an inner surface of the boot band includes at least one fastening element to permit the second end of the boot band to be folded onto itself and be attached to the inner surface of the boot band by first passing through the second slot and then being folded and attached to the inner surface so as to form a continuous circumferential member.

2. The boot accessory of claim 1, wherein the clip has a butterfly shape with the first and second side body extensions extending outwardly from the sides of the main body.

3. The boot accessory of claim 1, wherein a topmost section of each of the first and second slots lies below a topmost section of the clip so as to space the boot band below a top edge of the boot.

4. The boot accessory of claim 3, wherein each side body extension has a planar center section and a pair of inwardly angled sections at its two ends, the planar center sections being at least substantially parallel with each other and with the two sides of the main body.

5. The boot accessory of the claim 4, wherein a width of the boot band is substantially equal to a length of the planar center section.

6. The boot accessory of claim 1, wherein the main body is a single integral structure formed of a metal.

7. The boot accessory of claim 1, wherein the boot accessory in symmetrical about a center vertical axis.

8. The boot accessory of claim 1, wherein the boot band is formed of a fabric.

9. The boot accessory of claim 1, wherein the boot band is formed of an elastic material.

10. The boot accessory of claim 1, wherein the boot band is formed of an inelastic material.

11. The boot accessory of claim 1, wherein the at least one fastening element comprises first and second spaced pads of hook and loop material.

12. The boot accessory of claim 11, wherein the first and second pads are spaced a sufficient distance apart to allow a length of the boot band to be adjustable when inserted through the second slot and folded back onto itself.

13. The boot accessory of claim 1, wherein the finger and main body define a generally U-shaped structure.

14. A method for accessorizing a boot and changing its overall appearance comprising the steps of:

providing a boot accessory that includes a clip having a main body, a flexible finger extending from the main body, and first and second side body extensions that define first and second slots along two opposing sides of the main body, the boot accessory further including a decorative boot band having a first end and an opposing second end, the first end being fixedly attached to the first side body extension by passing through the first slot;

attaching the boot accessory to an upper edge of the boot by inserting the upper edge of the boot into a space defined between the finger and the main body and moving the clip down along the boot until the upper edge seats against the top of the clip;

wrapping the boot band around an upper leg portion of the boot;

inserting the second end of the boot band through into and through the second slot and folding the second end of the boot band onto itself; and attaching the folded second end of the boot band to an inner surface of the boot band using a fastening means such that the boot band extends circumferentially around the upper leg portion of the boot and is held in place thereal-long;

whereby the side body extensions are shaped and located along the sides of the main body such that the topmost portion of the clip is above the first and second slots thereby resulting in a topmost section of the upper leg portion of the boot being visible above an upper edge of the boot band.

* * * * *